US007517307B2

(12) United States Patent
Pokusa et al.

(10) Patent No.: US 7,517,307 B2
(45) Date of Patent: Apr. 14, 2009

(54) METHOD OF ASSEMBLING A CARTON BLANK INTO A CARTON

(75) Inventors: Kenneth C. Pokusa, Indian Head Park, IL (US); Panagiotis Kinigakis, Roscoe, IL (US)

(73) Assignee: Kraft Foods Global Brands LLC, Northfield, IL (US)

( * ) Notice: Subject to any disclaimer, the term of this patent is extended or adjusted under 35 U.S.C. 154(b) by 584 days.

(21) Appl. No.: 11/040,825

(22) Filed: Jan. 21, 2005

(65) Prior Publication Data

US 2006/0163335 A1 Jul. 27, 2006

(51) Int. Cl.
*B31B 1/62* (2006.01)

(52) U.S. Cl. ..... 493/128; 493/150; 493/264; 53/376.5; 53/377.4; 53/383.1

(58) Field of Classification Search ..... 53/376.6, 53/376.5, 377.4, 383.1; 493/128, 150, 264
See application file for complete search history.

(56) References Cited

U.S. PATENT DOCUMENTS

| | | | | |
|---|---|---|---|---|
| 3,668,369 | A | 6/1972 | Howe | |
| 3,788,876 | A | 1/1974 | Baker et al. | |
| 4,037,370 | A | 7/1977 | Williams | |
| 4,156,626 | A | 5/1979 | Souder | |
| 4,540,392 | A | 9/1985 | Junod et al. | |
| 4,699,684 | A | 10/1987 | Osborne | |
| 4,826,475 | A | 5/1989 | Eweryd | |
| 5,385,527 | A | 1/1995 | Fukada et al. | |
| 5,415,340 | A | 5/1995 | Calvert et al. | |
| 5,425,218 | A * | 6/1995 | Adams et al. | 53/463 |
| 5,498,304 | A | 3/1996 | Shaw et al. | |
| 5,537,806 | A * | 7/1996 | Grierson et al. | 53/491 |
| 5,690,775 | A | 11/1997 | Calvert et al. | |
| 5,728,249 | A | 3/1998 | Kinsey, Jr. et al. | |
| 5,732,533 | A * | 3/1998 | Focke et al. | 53/466 |
| 5,792,301 | A | 8/1998 | Calvert et al. | |
| 6,007,658 | A | 12/1999 | Calvert | |
| 6,122,897 | A * | 9/2000 | McClure | 53/411 |
| 6,226,965 | B1 * | 5/2001 | Lam | 53/491 |
| 6,417,483 | B1 | 7/2002 | Sator | |
| 6,474,046 | B1 * | 11/2002 | Ours et al. | 53/432 |
| 6,622,461 | B2 * | 9/2003 | Gambetti | 53/491 |
| 6,632,163 | B2 | 10/2003 | Zumbiel | |
| 2002/0142904 | A1 | 10/2002 | Zumbiel | |
| 2003/0041963 | A1 | 3/2003 | Gong et al. | |

(Continued)

FOREIGN PATENT DOCUMENTS

| | | |
|---|---|---|
| EP | 0875369 A3 | 4/2004 |

(Continued)

*Primary Examiner*—Hemant M Desai
(74) *Attorney, Agent, or Firm*—Fitch, Even, Tabin & Flannery

(57) ABSTRACT

A carton having a pair of end flaps for closing an end of the carton is disclosed. The end flaps each have at least one pre-applied adhesive deposit. When the end flaps of the carton are in their closed postions, the pre-applied adhesive deposit on one of the end flaps is generally in alignment and at least partially in contact with the pre-applied adhesive deposit on the other of the end flaps to permit the pre-applied adhesive deposits to adhesively bond.

12 Claims, 10 Drawing Sheets

U.S. PATENT DOCUMENTS

2004/0164135 A1 * 8/2004 Gong et al. ..... 229/132

FOREIGN PATENT DOCUMENTS

| | | | |
|---|---|---|---|
| JP | 8192825 | A2 | 7/1996 |
| JP | 11105815 | A2 | 4/1999 |
| JP | 2000072115 | A2 | 3/2000 |
| JP | 2001301704 | A2 | 10/2001 |
| JP | 2002067164 | A2 | 3/2002 |
| WO | WO 00/37580 | A1 | 6/2000 |
| WO | WO 03/016417 | A1 | 2/2003 |
| WO | WO 03/029109 | A2 | 4/2003 |
| WO | WO 03/029109 | A3 | 4/2003 |
| WO | WO 03/080324 | A1 | 10/2003 |

* cited by examiner

METHOD OF ASSEMBLING A CARTON BLANK INTO A CARTON

FIELD

Cartons and methods of assembling and producing such cartons are disclosed, and in particular cartons having pre-applied adhesives are disclosed.

BACKGROUND

Common methods of sealing cartons or box blanks into cartons and boxes include hot melt gluing and taping. Taping can be costly, due to the amount of labor typically involved and the cost of the tape. Taping can also be unsuitable for use in continuous, high speed commercial carton or box blank assembly operations. Thus, many high speed commercial carton or box blank assembly operations utilize hot melt gluing techniques to close open ends of the cartons or boxes.

The use of typical inline hot melt application system can be problematic. A typical hot melt application system includes a reserve container for hot melt adhesive. The reserve container is heated to maintain a supply of hot melt adhesive when required. A supply tube extends from the reserve container to a nozzle positioned adjacent the assembly path of the carton. A pump selectively feeds the holt melt adhesive from the reserve container, through the supply tube, and to the nozzle. A valve prior to the nozzle exit selectively controls the feed of hot melt adhesive from the nozzle exit onto a passing carton.

The use of reserve containers to hold the melted glue requires the exertion of energy to heat the glue, as a larger than necessary quantity of glue must be kept at a melted temperature. Another draw back of hot melt applicators is the requirement of stocking hot melt pellets for feeding into the reserve container, which can also increase the amount of labor necessary to operate the carton assembly machinery.

The hot melt applicators apply hot melt to an unassembled carton while the carton is moving through the assembly and filling equipment at high speed, which can be at about 100-250 feet per minute. The high speed of the partially assembled carton, and inherent deviations of the carton from a preferred orientation, can result in a large margin of error in the placement of the hot melt. In order to compensate for the margin of error, a larger quantity of hot melt adhesive may be used than would be necessary if there was a reduced margin of error. The use of a larger quantity of hot melt adhesive can waste hot melt adhesive, thereby increasing costs of carton assembly, requires more energy to heat to the glue to the appropriate temperature, and can cool faster once applied to a carton.

Another problem with hot melt applicators, such as illustrated in FIG. 19, is that they require high maintenance. The hot melt application systems must be cleaned on a regular basis to prevent the build up of hot melt in the hot melt reserve container, supply line and, and in particular, nozzles. When hot melt builds up in the nozzle exits of the hot melt applicators, a decrease in the efficiency and a decrease in the accurate placement of the hot melt on a passing carton can occur. Inaccurate placement of the hot melt on a passing carton can cause alignment difficulties when the flaps are closed. For example, an inaccurately placed portion of typical hot melt adhesive can be too far inwardly from the outward edge of a flap. When that flap is pressed against an opposite flap, the outward edge may partially deflect the opposite flap, as illustrated in FIG. 11. In some circumstances, this can cause only a portion of the hot melt adhesive to be bonded to the opposite flap.

The use of typical hot melt adhesives can also lead to adhesion problems. When used to join carton flaps, a hot melt adhesive deposit is bonded on one side to one of the carton flaps and on the other side to the other one of the carton flaps. The holt melt adhesive may not achieve its full bonding strength to the carton flaps until long after the cartons have been filled and assembled, which can require the extended use of compression guides or other mechanisms to hold the carton flaps in the closed orientations for the hot melt adhesive to adequately set. In addition, when one side of the carton has a graphic printed thereon, the hot melt adhesive may not properly wet or diffuse into the printed portion of the carton, thus further increasing the time for adequate bonding of the hot melt adhesive to the carton flaps.

SUMMARY

A method of assembling a preconfigured carton or box blank into a carton or box is disclosed. The method includes providing a preconfigured carton blank having one or more open ends. The opened end of the carton blank has a first major flap and an opposing second major flap. The first major flap has an activateable adhesive deposit disposed on an outer surface thereof. Optionally, the second major flap may also have an activateable adhesive deposit on an inner surface thereof. The method includes activating the adhesive deposits on the first and, if present, on the second major flaps using an energy source. The method also includes moving the first and second major flaps to generally close the open end of the preconfigured carton blank with the second major flap at least partially overlying the first major flap. If the adhesive deposit is present on the second major flap, the method may also include at least partially aligning the adhesive deposit on the inner surface of the second major flap with the adhesive deposit on the outer surface of the first major flap to provide an adhesive bond between the deposits to secure the first and second major flaps relative to each other to close the open end of the carton.

The method of assembling a preconfigured carton blank into a carton may include the step of moving the first and second major flaps prior to the step of activating the adhesive deposits. Alternatively, the step of moving the first and second major flaps may occur after the step of activating the adhesive deposits.

The method of assembling a preconfigured carton blank into a carton may include using an energy source that is at least one of a laser, hot air, heat lamp, radio waves and induction heating to activate the adhesive deposits. The activateable adhesive deposit on the first major flap may be different from the activateable adhesive deposit on the second major flap. The activateable adhesive deposits may be reactive with each other to provide the adhesive bond or cross-linking between the adhesive deposits on the first major flap and the second major flap to close the end of the carton.

The method of assembling a preconfigured carton blank into a carton may include the step of printing graphics on the carton blank and placing adhesive deposits on the carton blank while the carton blank is in a generally planar configuration. This can permit increased accuracy in the placement of the adhesive deposits as compared to placing such adhesive deposits on a partially assembled carton blank during a filling and assembling operation.

The method of assembling a preconfigured carton blank into a carton may include the steps of providing the preconfigured carton blank with a second open end opposite the first end. The second open end of the carton may have a third major flap and an opposing fourth major flap. The third major flap may have an activateable adhesive deposit disposed on an outer surface thereof. The fourth major flap may also have an activateable adhesive deposit disposed on an inner surface thereof. The method may include activating the adhesive deposits on both the third and fourth major flaps proximate the second open end of the carton using an energy source. The method may also include moving the third and fourth major flaps to generally close the second open end of the preconfigured carton blank with the fourth major flap, at least partially overlying the third major flap. The major may also include at least partially aligning the adhesive deposit on the inner surface of the fourth major flap with the adhesive deposit on the outer surface of the third major flap to provide an adhesive bond to secure the third and fourth major flaps relative to each other to generally close the second open end of the carton.

The method may also include the steps of moving the first and second major flaps and the step of moving the third and fourth major flaps generally simultaneously. The method may also include the step of at least partially aligning the adhesive deposit on the inner surface of the second major flap with the adhesive deposit on the outer surface of the first major flap and the step of at least partially aligning the adhesive deposit on the inner surface of the fourth major flap with the adhesive deposit on the outer surface of the third major flap generally occurring simultaneously.

The step of providing the preconfigured carton blank may include the step of providing the preconfigured carton blank in a partially assembled, collapsed state, where the carton has front panel and a back panel and a pair of side panels extending between opposing edges of the front and back panel. The first and second major flaps may be positioned at edges of the front and back panels other than the edges having the side panels. The third and fourth major flaps may be positioned at edges of the front and back panel other than the edges having the side panels and opposite the edges having the first and second major flaps. In the collapsed state, the front and back panels may be generally adjacent to each other and the adhesive deposits on the first and second major flaps are unaligned. In addition, the adhesive deposits on the third and fourth major flaps may also be unaligned in the collapsed state.

Providing the adhesive deposits in an unaligned orientation when the carton is in its collapsed state can provide for improved stacking capabilities of the preconfigured carton blank in the collapsed state. Instead of having a single large adhesive deposit on only one of the first and second or the third and fourth major flaps, the division of a larger deposit into two thinner and, in the collapsed state, staggered adhesive deposits can reduce the overall thickness of the preconfigured carton blank in the collapsed state. When multiple preconfigured carton blanks in their collapsed states are stacked on top of each other, the division of the adhesives deposits between the first and second or third and fourth major flaps can improve the stability of the stack of cartons and provide for ease of removal of a single preconfigured carton blank in its collapsed state from the stack of multiple such carton blanks.

The step of providing the carton blank may include the step of removing the preconfigured carton blank from a stack having a plurality of preconfigured carton blanks. The step of providing a carton blank may also include the step of shifting the preconfigured carton blank from the collapsed state to an upright state where the sidewalls are approximately perpendicular to the front and back panels. The method may also include inserting a food product into the preconfigured carton blank through the carton opening prior to the step of moving the first and second flaps to close the carton opening and after the step of shifting the preconfigured carton blank from the collapsed state to the upright state.

Each of the side panels may have a pair of minor flaps positioned on opposing edges thereof adjacent the front and back panels. The method may include the step of moving the minor flaps to an approximately perpendicular orientation relative to the side panels prior to the step of moving the major panels to their generally perpendicular orientation relative to the front and back panels.

In another aspect, a generally planar carton or box blank is provided that is convertible into a carton or box. The generally planar carton blank may include a generally rectangular front panel having a pair of first major flaps positioned on opposing thereof. The generally planar carton blank may also include a generally rectangular back panel having a pair of second major flaps positioned on opposing edges thereof. A first side panel extends between opposing edges of each of the front and back panels adjacent the edges of the front and back panels having the first and second major flaps. A second side panel is attached to an edge of one of the front and back panels opposite the edge connected to the first side panel. A closing flap is attached to an edge of the other of one of the front and back panels opposite the edge connected to the second panel. The closing flap is positioned to be securable to the one of the front and back panels to form a partially assembled carton configuration. In the partially assembled carton configuration, one of the side panels and the front panel are generally planar and the other of the side panels and the back panel and are also generally planar. One of the front and back panels is partially overlying the other of the front and back panels. The generally planar carton blank also includes one activateable adhesive deposit disposed on an outer surface of one of the pair of first major flaps. At least one activateable adhesive deposit is also disposed on an inner surface of the second major flap opposite the one of the pair of first major flaps. The adhesive deposits on the first and second major flaps are positioned such that when the second major flaps overlies the first major flap the adhesive deposits are at least partially aligned. When the carton blank is in the partially assembled carton configuration, the adhesive deposits are not aligned.

According to one aspect, the carton blank may include graphics printed on at least one of the front, back and side panels.

According to another aspect, the adhesive deposits are activateable by energy source. The energy source may include at least one of the laser, hot air, heat lamp, radio waves and induction heating. The activateable adhesive deposit on the first major flap may be different from the activateable adhesive deposit on the second major flap. When the activateable adhesive deposits on the first and second major flaps are different, they may be reactive with each other to provide an adhesive bond when brought into contact with each other.

DETAILED DESCRIPTION OF THE DRAWINGS

Cartons and boxes having a pair of end flaps for closing an end of the carton is disclosed in FIGS. 1-10, 12, 13, 15-18 and 20. At least one, and preferably both, of the end flaps at an end of the carton or box has a pre-applied adhesive deposit. When the end flaps of the carton are in their closed positions, the pre-applied adhesive deposit on one of the end flaps is generally in alignment and at least partially in contact with the pre-applied adhesive deposit on the other of the end flaps to permit the pre-applied adhesive deposits to adhesively bond. When the cartons are in a partially assembled, collapsed configuration and the end flaps of the cartons are in an open position, the adhesive deposits which will align when the carton is assembled are preferably staggered.

Figure 1:
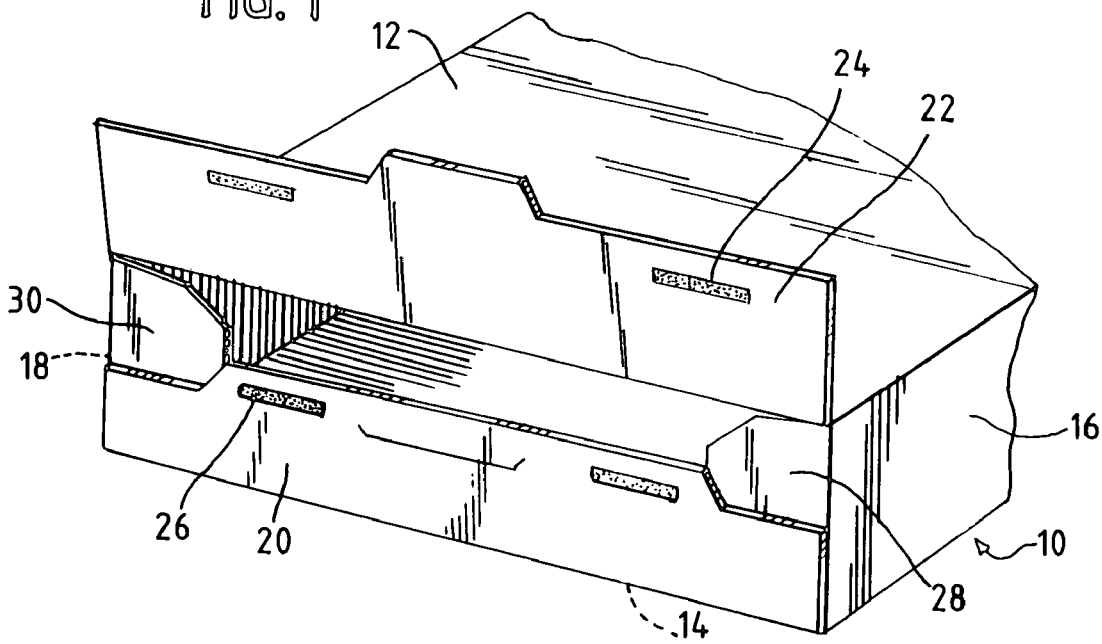
FIG. 1 is a perspective view of a carton in a partially assembled configuration with a second major flap in a raised position and a first major flap in a closed position with adhesive pre-applied to both major flaps.
Figure 2:
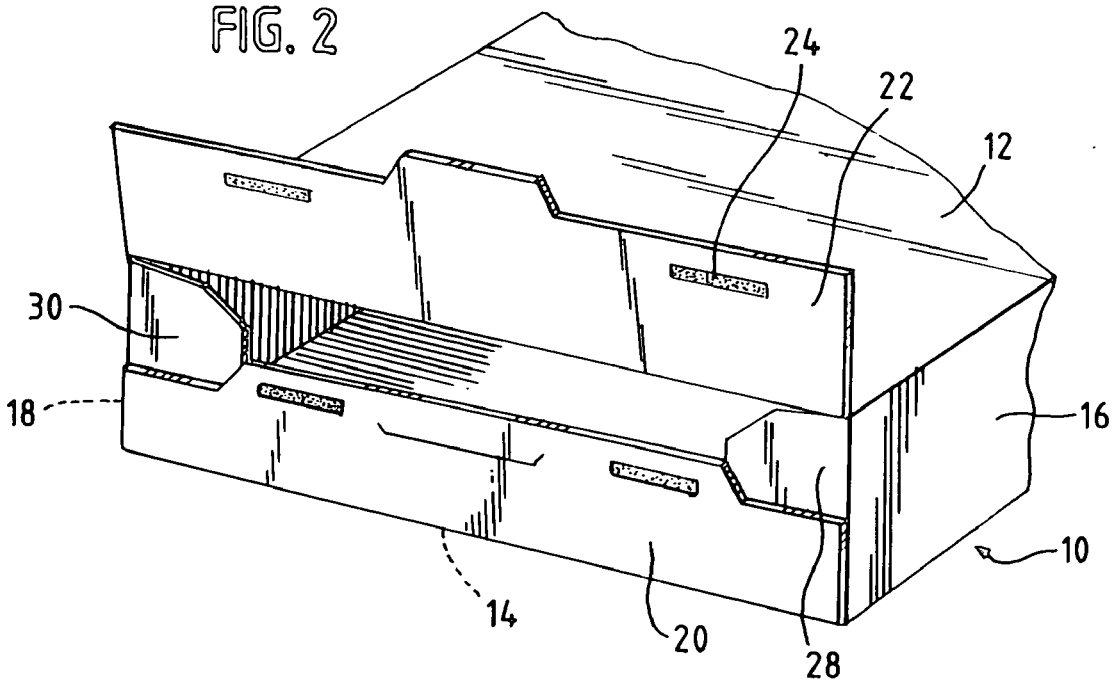
FIG. 2 is a perspective view of a carton in a partially assembled configuration with a second major flap in a raised position and a first major flap in a closed position with adhesive pre-applied to one of the major flaps.
Figure 4:
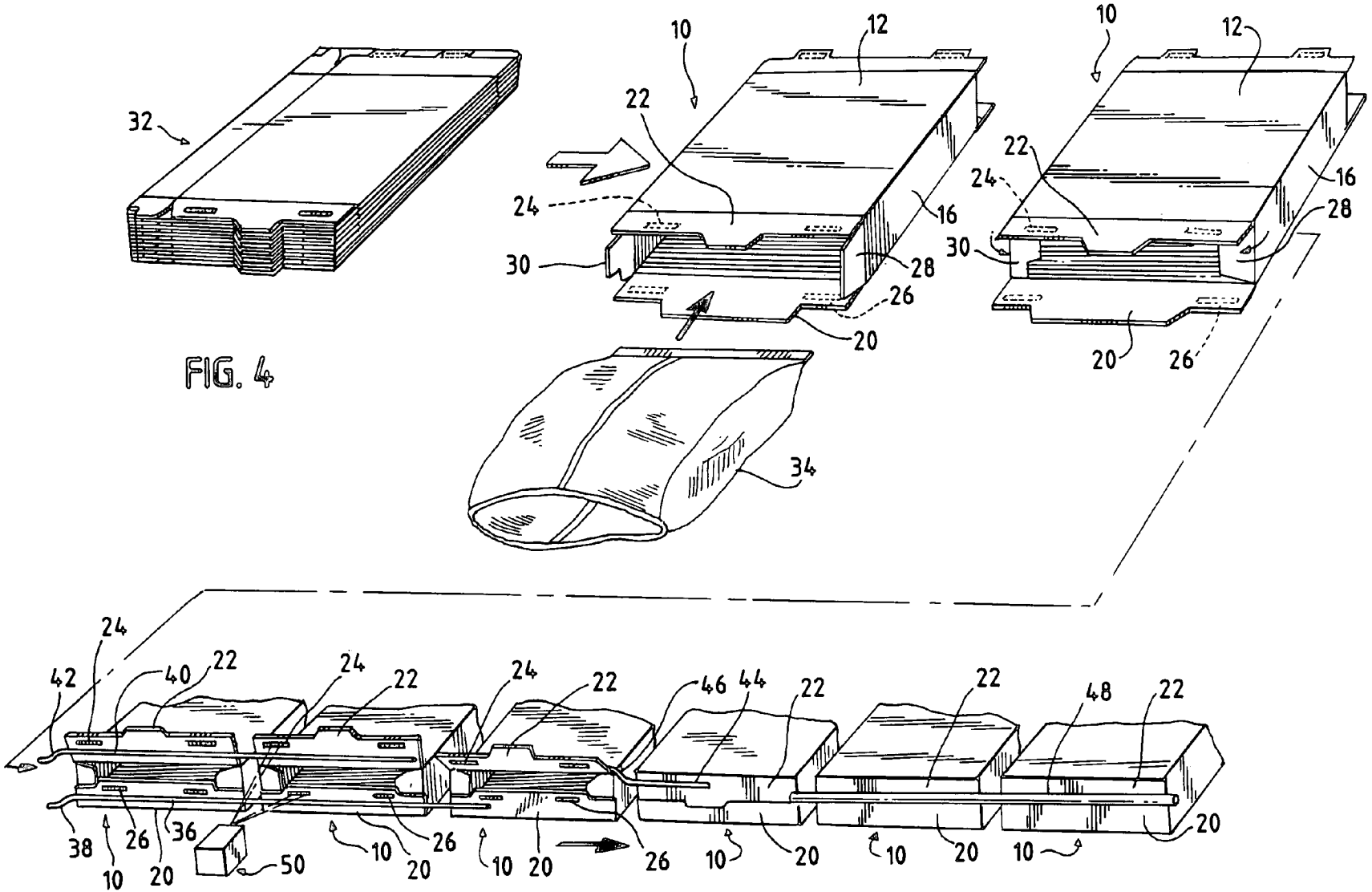
FIG. 4 is a diagrammatic illustration of steps for converting a carton from a collapsed carton configuration to a filled and closed carton configuration.

As shown in FIG. 1, a carton 10 has an activateable adhesive deposit 26 is pre-applied in predetermined locations to an outer side of a first major flap 20 and another activateable adhesive deposit 24 is pre-applied in predetermined locations to an inner side of a second major flap 22. Initially, the first major flap 20 is shifted from an open position to a closed position, as illustrated in FIG. 4. When the first major flap 20 is in its closed position, as illustrated in FIG. 1, the adhesive deposits 26 are outwardly facing. Next, the second major flap 22, along with its inwardly facing adhesive deposits 24, is shifted from an open position to a closed position, as illustrated in FIG. 4. When the first and second major flaps 20 and 22 are in their closed positions, their respective adhesive deposits 26 and 24 are generally aligned and pressed together to form an adhesive bond between the adhesive deposits 26 and 24, as will be discussed in greater detail below. Thus, the adhesive bonding between the adhesive deposits 26 and 24 results in the first and second major flaps 20 and 22 being secured to close the end of the carton 10. Adhesive deposits can also be used in a like manner to close major flaps on an opposite end of the carton 10.

The adhesive can be pre-applied to one flap or split between different flaps. If the adhesive is split between different flaps, then the adhesive can preferably be patterned on the flaps such that they overlap when the flaps are closed to facilitate bonding. In one aspect, half of the adhesive 26 may be patterned on the outside of the inner flap 20 and the other half 24 patterned on the inside of the outer flap 22. Splitting the adhesive between two flaps 20 and 22 can allow for the possibility of applying a two part adhesive, i.e., the use of two distinct adhesive formulations, one on each flap 20 and 22. This can be useful when applying adhesive that becomes a thermal set after activation. In addition, splitting the adhesive thickness between two flaps 20 and 22 can provide for improved stacking capabilities of the carton blanks 64, as will be discussed in greater detail below. Splitting the adhesive between the flaps 20 and 22 can also overcome the challenges of properly wetting the flaps during closing because the adhesive bonds to the aligned adhesive deposits 24 and 26 during carton assembly, as opposed to between a pair of flaps. The thickness of the pre-applied adhesives 24 and 26 can be minimized when the adhesive is split between the two flaps 20 and 22 that are to be joined. Thus, the carton blank 64 can stay relatively flat or planar, especially as compared to the use of a single adhesive deposit that is not split between the two flaps 20 and 22 to be joined. Splitting the adhesive also has the advantage of decreasing the volume of the adhesive that is to be activated using an energy source.

Figure 9:
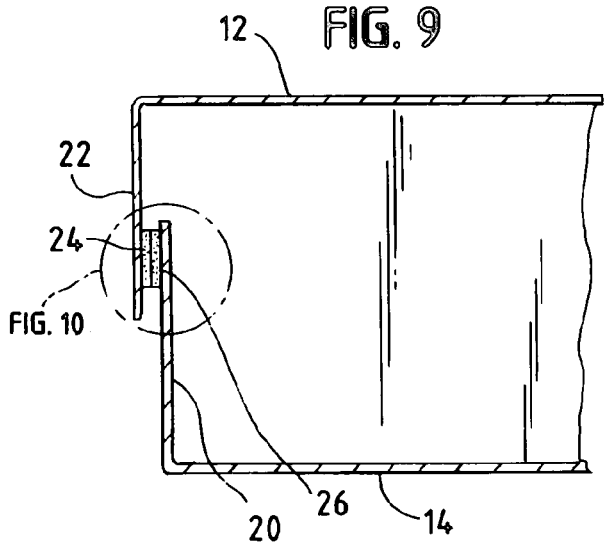
FIG. 9 is a partial section elevation view taken along plane 9-9 of a closed end of the carton of FIG. 8 in an assembled configuration.
Figure 10:
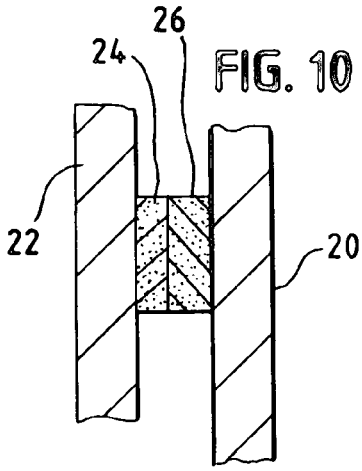
FIG. 10 is a detailed view of a portion of FIG. 9.

The adhesive deposits 24 and 26 to be pre-applied may be similar to hot melt thermoplastic adhesives or it may be a formulation that becomes a thermoset after heating. A preferred type of adhesive is disclosed in U.S. patent application Ser. No. 10/199,379, the disclosure of which is hereby incorporated by reference in its entirety. Preferably, the pre-applied adhesive deposits 24 and 26 comprise two different, curable hot melt adhesives 24 and 26, as illustrated in FIGS. 9 and 10. Each component 24 and 26 can have an activation temperature greater than ambient temperatures typically present in carton converting, filling and assembling operations. The temperatures of the pre-applied adhesive deposits 24 and 26 can then be selectively increased during carton assembly using an energy source 50. The two different pre-applied adhesive deposits 24 and 26 are preferably reactive with each other to form a cross-linked bond between each other. Thus, the activated adhesive deposits 24 and 26 can form a bond between each other, as opposed to forming a bond between a pair of carton flaps 20 and 22. This can reduce or eliminate the problems with typical prior art hot melt adhesives discussed above.

Figure 11:
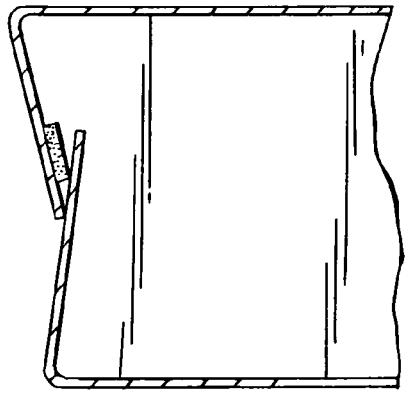
FIG. 11 PRIOR ART
FIG. 11 is a partial section elevation view of a closed end of a prior art carton in an assembled configuration.

By forming the adhesive bond between the pre-applied adhesive deposits 24 and 26, difficulties in the prior art of bonding a single deposit of hot melt adhesive to two different paperboard flaps during a high-speed assembly operation can be reduced. For example, the increased precision in the placement of the pre-applied adhesives 24 and 26 can increase the amount of the adhesive deposits 24 and 26 that are in contact with each other. This can also reduce the quantity of adhesive in each deposit 24 and 26 needed to secure the pair of flaps 20 and 22 together. Instead of a larger hot melt adhesive deposit necessary to overcome imprecise placement, as illustrated in FIG. 11, smaller quantities of the pre-applied adhesive deposits 24 and 26 can be used. In addition, improperly applied or overly applied hot melt adhesive can cause squeeze-outs at edges of the flaps, which can cause build-ups on the guide rails and misfeeds of the cartons.

Figure 3:
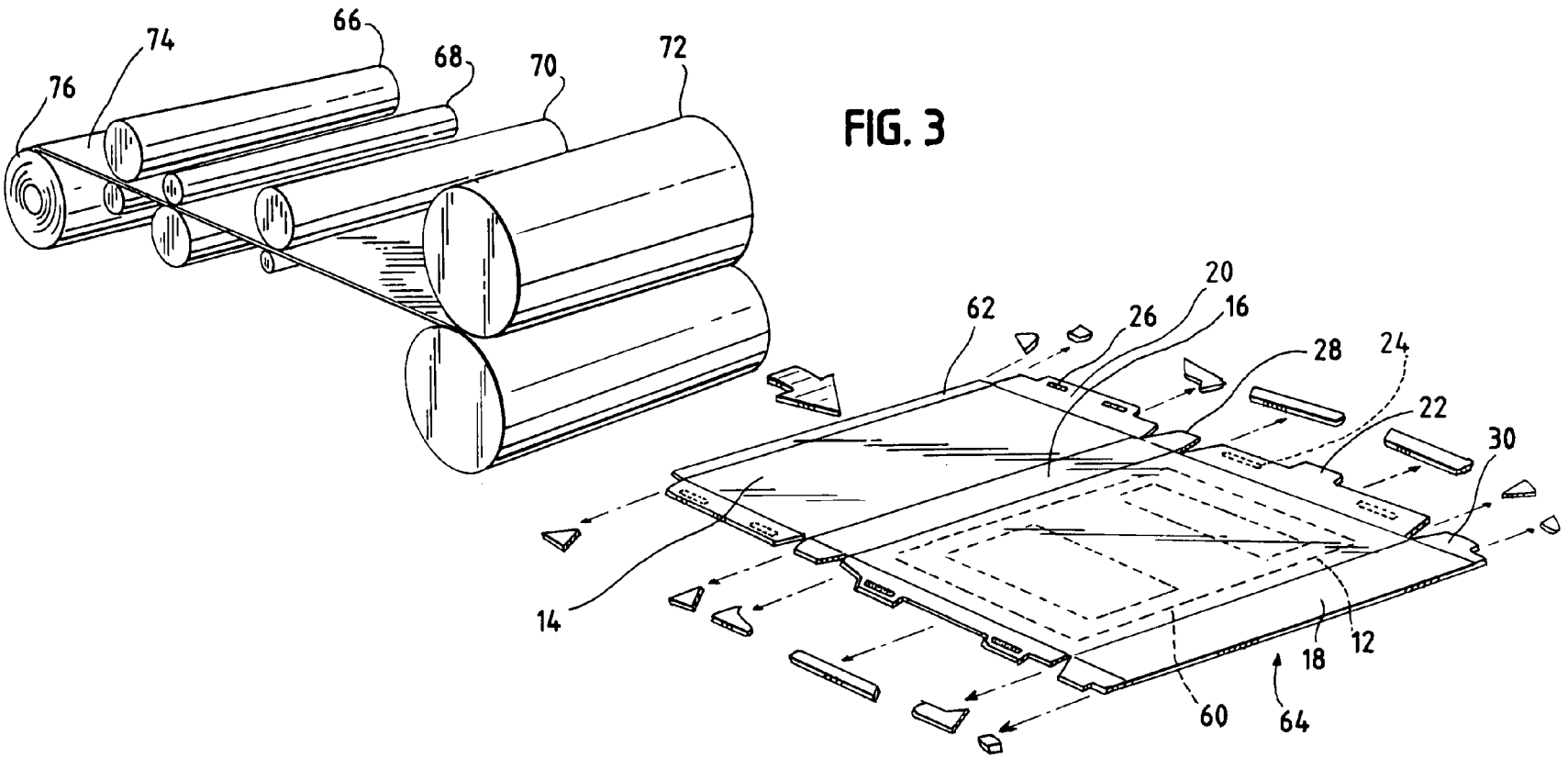
FIG. 3 is a diagrammatic illustration of steps for converting stock paperboard into a carton blank.

The carton 10 undergoes several configurations before its completion. Initially, the carton 10 is in the configuration of a generally planar carton blank 64, as illustrated in FIG. 3. The carton blank 64 has a front panel 12 with a pair of sidewalls 16 and 18 connected to longitudinal edges thereof. One of the sidewalls 16 has a back panel 14 connected to an edge opposite the front panel 12. A closure flap 62 is connected to an edge of the back panel 14 opposite the sidewall 16 connected thereto. A pair of major flaps 20 and 22 extend from aligned edges of the front panel 12 and back panel 14 at one end of the panels 12 and 14, and a second pair of major flaps extend from aligned edges of the front and back panels 12 and 14 on an opposite ends of the panels 12 and 14. Minor flaps 28 and 30 extend from edges of the sidewalls 16 and 18 that are adjacent the major flaps 20 and 22.

The carton blank 64 may be printed with graphics 60, such as brand logos and contents information. Preferably, although not necessarily, the adhesive deposits 24 and 26 may also be pre-applied to the carton blank 64 at or about the time of being printed. The placement of the adhesive deposits 24 and 26 can be accomplished by using rollers, nozzles, or other such suitable equipment. Placing the adhesive deposits 24 and 26 on the carton blank 64 can result in more precise placement of the adhesive deposits 24 and 26 on the carton blank 64, in particular as compared to traditional methods of placing hot melt adhesive on non-planar, partially assembled moving cartons during high speed manufacturing operations. Part of the increased precision in placement of the adhesive deposits 24 and 26 can be attributed to this operation being performed on a generally planar carton blank 64.

The carton blank 64 can be formed from a roll of stock paperboard 76, as illustrated in FIG. 3. The roll of stock paperboard 76 is unwound into a planar sheet 74 and fed through a printing roller 66 and a pair of adhesive deposit rollers 68 and 70. The printing roller 68 can print the graphics 60 on an outer surface of the paperboard sheet 74, one of the adhesive rollers 68 can place the adhesive deposits 24 on the inner surface of the second major flap 22 and another of the adhesive rollers 70 can place the adhesive deposits 26 on the outer surface of the first major flap 20. Preferably, the adhesive deposits 24 and 26 are placed in predetermined locations on the flaps 20 and 22, such as those locations described above which result in their alignment when the carton is fully assembled. After passing through the rollers 68 and 70, the paperboard 74 can be directed to a die cutter 72, where the paperboard 74 is die cut into the carton blank 64. Crease lines between the various flaps and panels can also be made concurrently with the die cutting operation. Although one particular method of producing carton blanks 64 having pre-applied adhesive deposits 24 and 26 is described, other methods may also be suitable.

Figure 12A:
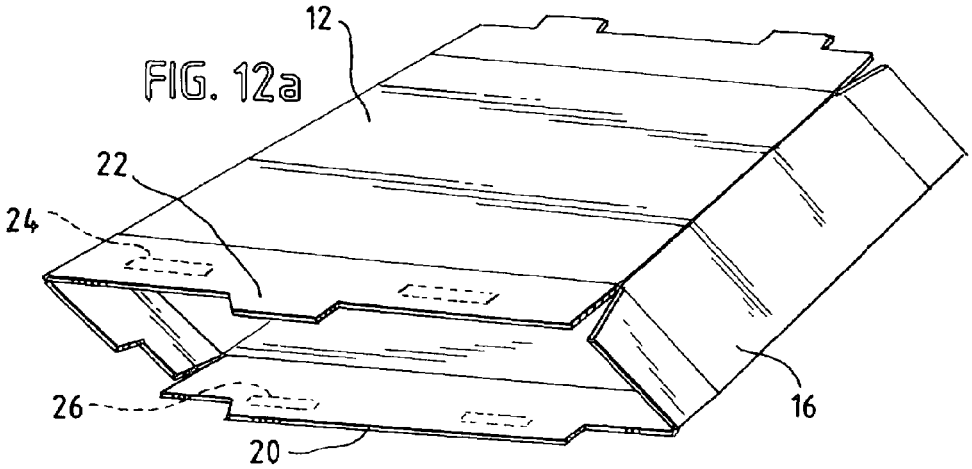
FIG. 12*a* is a perspective view of the carton of FIG. 1 in a partially collapsed configuration.
Figure 12B:
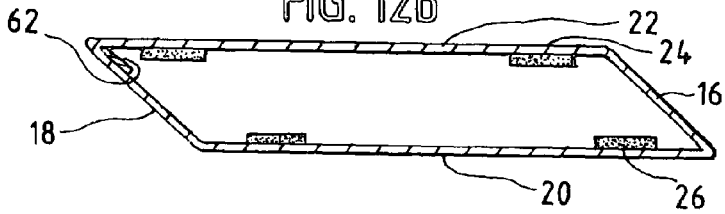
FIG. 12*b* is a front elevation view of the carton of FIG. 12*a* in a partially collapsed configuration.
Figure 12C:
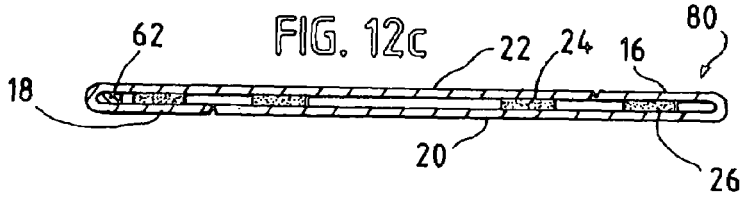
FIG. 12*c* is a front elevation view of the carton of FIG. 12*a* in a collapsed configuration.

After the carton blank 64 is formed it can be assembled into a partially assembled, collapsed carton configuration 80, such as illustrated in FIGS. 12*a*, 12*b* and 12*c*. In the collapsed carton configuration 80, folds are made between the front and back panels 12 and 14 and sidewalls 16 and 18 to form the carton blank 64 into a generally trapezoidal end profile, as illustrated in FIGS. 12*a* and 12*b*. The closure flap 62 is adhesively adhered to the inner side of the sidewall 18 to secure the carton blank 64 into the collapsed configuration 80. The collapsed carton 80 can be shifted to a fully collapsed configuration, as illustrated in FIG. 12*c*, where the front panel 12 and one of the sidewalls 18 are generally planar, the back panel 14 and the other one of the sidewalls 16 are generally planer and the front panel 12 overlies the back panel 14.

The forming and printing of the carton blank 64, pre-application of the adhesive deposits 24 and 26 and assembly of the carton blank 64 into the collapsed configuration 80 may be performed at a carton converter, i.e., at a location different from where the carton 10 is filled and/or finally assembled. The pre-application of adhesive deposits 24 and 26 at a carton converter can have numerous advantages. As discussed above, for example, the pre-application of adhesive deposits 24 and 26 while the carton 10 is still in the form of a carton blank 64 can result in more precise placement of the adhesive deposits. This can have the benefit of requiring less adhesive deposit 24 and 26, as will be discussed in greater detail below. Another benefit of the pre-application of adhesive is that the location where the carton 10 is filled and/or assembled, if different from the carton converter, does not have to stock the adhesive. This can save floor space, handling and maintenance costs for the carton filler and/or assembler. Adhesive deposits can also be pre-applied at much faster speeds at a carton converter, where line speeds can be between about 500-1200 feet per minute, as opposed to at the filler and/or assembler, where line speeds can be between about 100 and 250 feet per minute.

Figure 13:
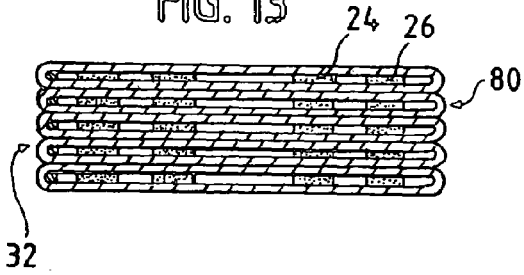
FIG. 13 is a side elevation view of a stack of the cartons of FIG. 1 in a collapsed configuration.
Figure 14:
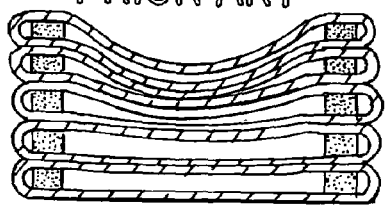
FIG. 14 PRIOR ART
FIG. 14 is a side elevation view of a stack of prior art cartons in a collapsed configuration.

After the cartons 10 have been assembled into the collapsed configuration 80, they are often placed into individual stacks 32, which can number into the hundreds of cartons. If the cartons 10 in their collapsed configurations 80 were perfectly planer, i.e., no crease lines and no pre-applied adhesive deposits 24 and 26, then the collapsed cartons may remain generally planar when stacked. However, when a stack 32 of collapsed cartons 80 has the pre-applied adhesive deposits 24 and 26, the deposits 24 and 26 can act as columns if placed directly on top of each other. The weight of the collapsed cartons 80 can cause the cartons 80 to sag in their mid-sections. If a single set of typical prior art hot melt deposits (as opposed to the thinner pre-applied deposits of FIG. 2) are pre-applied to just a pair of major flaps (and not split between the first and second major flaps, as in FIG. 1), the deposits can act as a pair of columns and can lead to sagging in the mid-section of the carton stack 32, as illustrated in FIG. 14. Such sagging can hinder removal of a single collapsed carton from the stack of collapsed cartons, such as during assembly and filling operations. Splitting the adhesive deposits 24 and 26 between pairs of major flaps 20 and 22 can alleviate sagging of stacks 32 of collapsed cartons 80 by acting as staggered, as opposed to aligned, columns. For example, the adhesive deposits 26 on the first major flaps 20 are preferably unaligned with the corresponding adhesive deposits 24 on the second major flaps 22, as illustrated in FIG. 13. Splitting the adhesive deposits 24 and 26 between pairs of major flaps 20 and 22 can also reduce the thickness of the adhesive deposits 24 and 26 on each flap, thereby decreasing the overall thickness of the collapsed carton 80 at that location. When such collapsed cartons 80 are stacked, sagging can also be reduced due to the decreased thickness of the collapsed cartons 80 at the locations of the adhesive deposits 24 and 26.

The cartons 10 can be converted from their collapsed, partially assembled configuration 80 to an assembled configuration in a generally continuous, high speed, commercial manufacturing process, as illustrated in FIG. 4. During the assembly, contents 34 can optionally be inserted into the carton 10.

In one method of assembling a carton 10, a collapsed carton 80 having the pre-applied adhesive deposits 24 and 26 is withdrawn from a stack of cartons 32. The collapsed carton 80 is then converted into an upright configuration with the major and minor flaps 20, 22 and 28, 30 remaining generally planar with their attached panels 12, 14 and walls 16, 18. While in the upright configuration, the contents 34 can be inserted into the carton interior. Next, the minor flaps 28 and 30 are shifted to their closed configurations. Optionally, the minor flaps 28 and 30 may be omitted. The first major flap 20 and second major flap 22 are then shifted in the same direction, such that the first major flap 20 is shifted to its closed position and the second major flap 22 is shifted to an extended open position. The shifting can be accomplished by directing the carton 10 past guide bars 36 and 40 having curved portions 38 and 42 to initially shift the flaps 20 and 22 and then maintain the flaps 20 and 22 in the preferred orientations. By shifting the first major flap 20 to its closed position and the second major flap 22 to its extended open position, the adhesive deposits 26 and 24 on each of the flaps 20 and 22 are facing in a common outwardly direction. After positioning of the deposits 24 and 26, the carton 10 is directed past an energy source 50 which directs energy onto the deposits 24 and 26 to activate the adhesive deposits 24 and 26. Following activation of the adhesive deposits 24 and 26, the second major flap 22 is shifted as it is guided past a curve 46 in a guide bar 44 to its closed position, whereby the adhesive deposits 26 and 24 on the first and second major flaps 20 and 22 are aligned and joined together to adhesively bond. Bonding between the adhesive deposits 24 and 26 secures the first and second major flaps 20 and 22 relative to each other, thereby closing the carton 10. A compression guide 48 may optionally be used to ensure that the aligned adhesive deposits 24 and 26 are firmly pressed together. Although the assembly of the carton 10 is described and illustrated for one open end of the carton 10, identical steps can simultaneously be performed on the other open end of the carton 10 to close both ends thereof.

Figure 5:
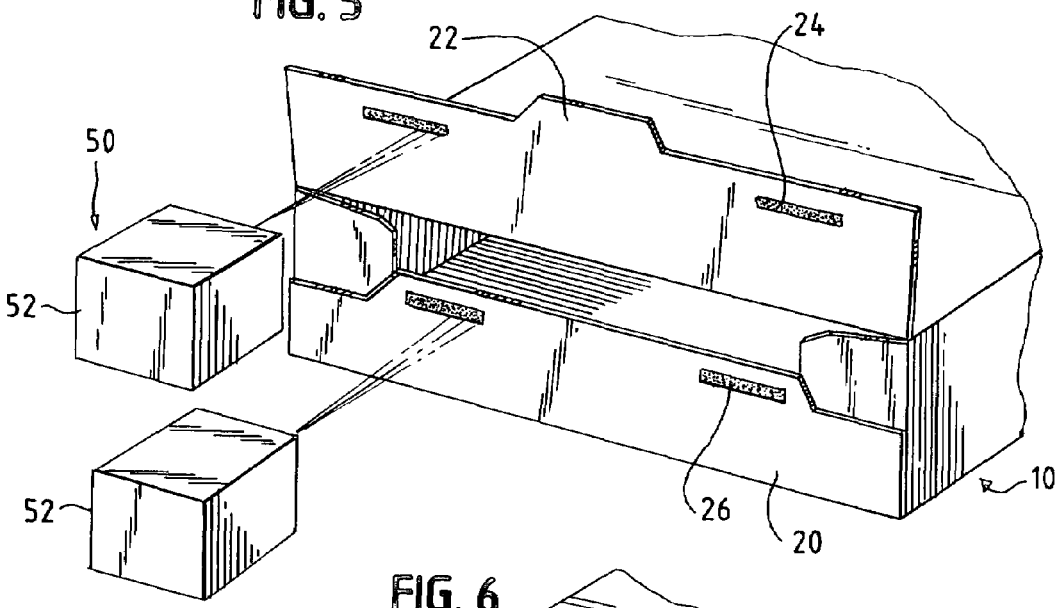
FIG. 5 is a diagrammatic illustration of an energy source for activating adhesive deposits on a carton.
Figure 6:
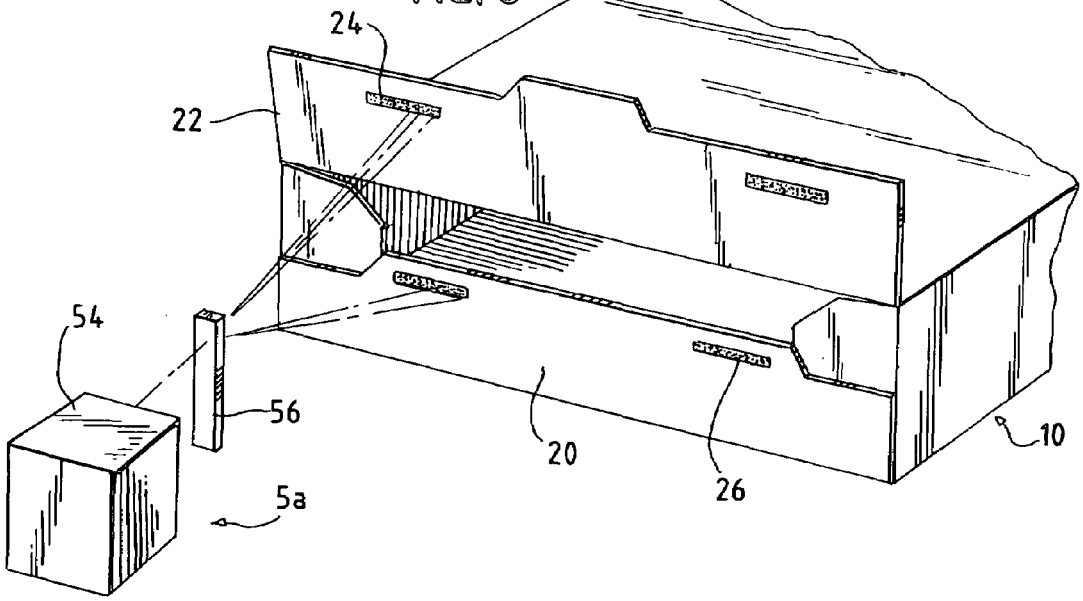
FIG. 6 is another diagrammatic illustration of an energy source for activating adhesive deposits on a carton.
Figure 7:
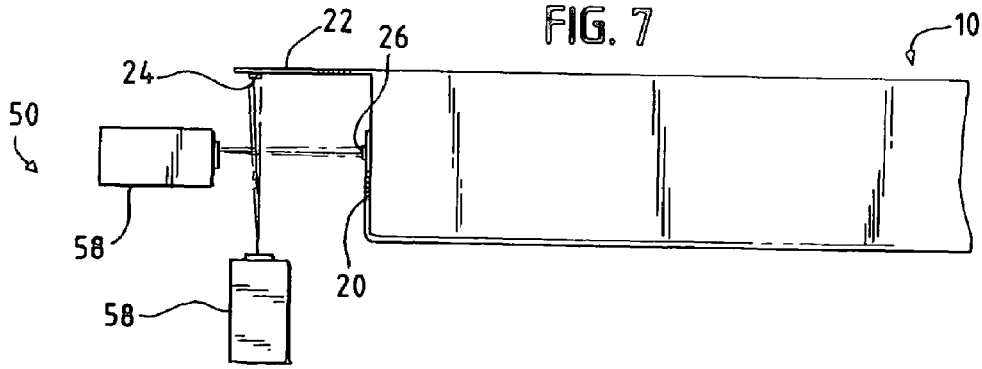
FIG. 7 is another diagrammatic illustration of an energy source for activating adhesive deposits on a carton.
Figure 8:
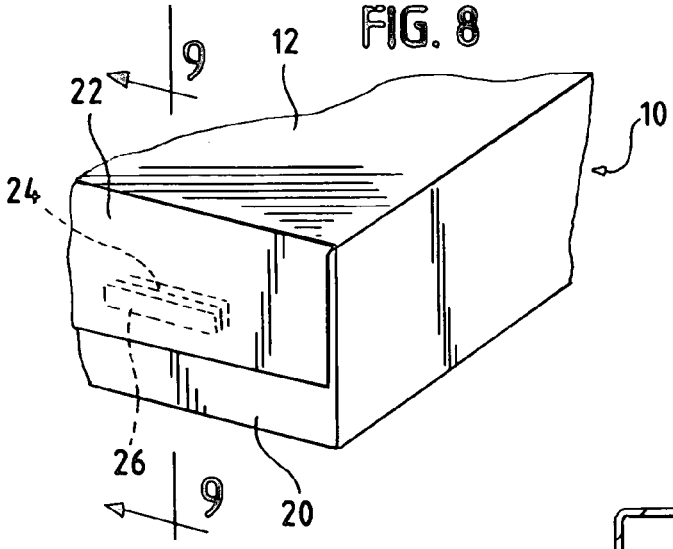
FIG. 8 is a partial perspective view of the carton of FIG. 1 in an assembled configuration.

The energy source 50 is preferably multiple laser beams which are each directed with general precision upon one of the adhesive deposits 24 or 26 to activate the adhesive deposit 24 or 26 by raising the temperature thereof. The laser energy source 50 may comprise multiple sources 52 for each row of adhesive deposits 24 and 26, as illustrated in FIG. 5. Alternatively, a single laser source 54 may have its beam divided by an optical lens 56 into multiple beams with each beam being directed at a row of adhesive deposits 24 and 26, as illustrated in FIG. 6. In yet another alternative, multiple laser sources 58 may have beams positioned perpendicularly and the second major flap 22 may not be shifted to its extended open position, but rather left in its position of being generally planar with its attached panel 12, as illustrated in FIG. 7. Although laser energy sources are presently preferred, the energy source 50 may be of another directed type, such as hot air blowers, heat lamps, radio waves and induction heating.

The energy source 50 is preferably pulsed, such that it is activated only when the adhesive deposit 24 or 26 is passing thereby. For example, a first major flap 20 having two spaced apart adhesive deposits 26 in a single row may pass the energy source 50 which is activated when the leading adhesive deposit 26 is passing, deactivated, and then reactivated when the trailing adhesive deposit 26 is passing. This can have the benefit of reducing energy consumption by only using the energy source 50 when the adhesive deposit 26 is in position to be activated. An additional benefit can be a reduction in potentially undesired heating of the carton material disposed between the adhesive deposits 26 in a row.

Although the use of a pre-applied adhesive is discussed above with respect to cartons 10, and in particular paperboard cartons 10, other types of packages can also use such concepts of the pre-applied adhesive. For example, the pre-applied adhesive may be used to assemble corrugated boxes 100. In addition, the carton or box 100 having four end flaps can use pre-applied adhesives on all four flaps to provide for increased strength and or closing properties of the carton or box.

Although the above discussion has been directed to cartons of the paperboard type, the disclosure is equally applicable to other types of cartons and carton materials. For example, the term carton as used herein encompasses other types of packages and materials, such as boxes and corrugated cardboard boxes.

Figure 15:
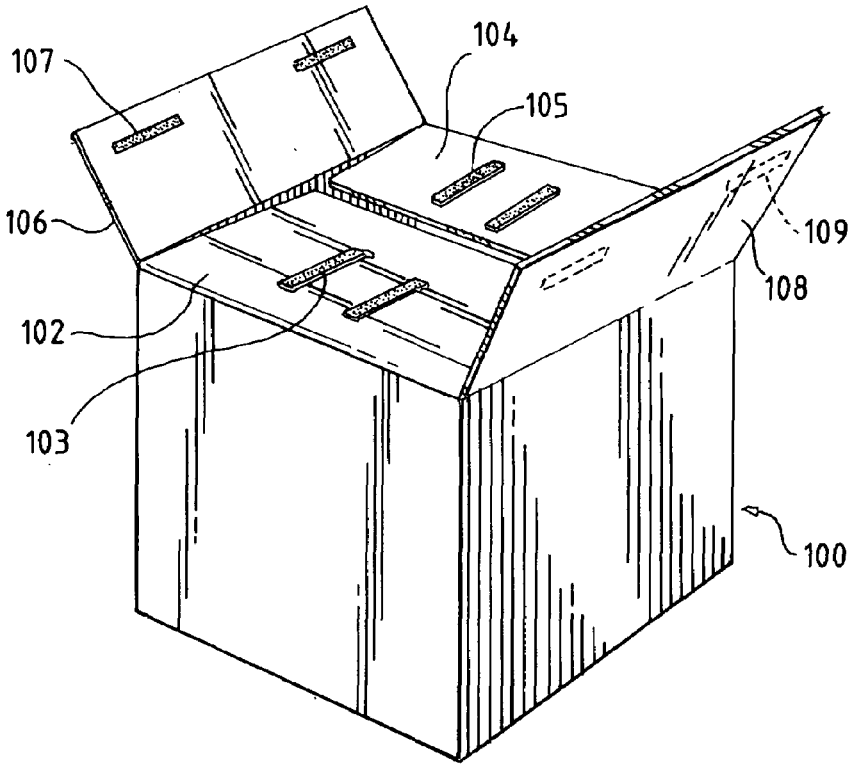
FIG. 15 is a perspective view of a box in a partially closed configuration.

Activateable, pre-applied adhesives can also be used in forming regularly slotted boxes 100, such as illustrated in FIGS. 15-18. The box 100 may have four major flaps 102, 104, 106 and 108 on each end, an inner pair 102 and 104 and an outer pair 106 and 108, as illustrated in FIG. 15. Each of the inner pair of flaps 102 and 104 may have a pair of pre-applied adhesive deposits 103 and 105, and each of the outer pair of flaps 106 and 108 may also have a pair of pre-applied adhesive deposits 107 and 109. The adhesive deposits 103, 105, 107 and 109 are positioned such that, when closed, one of the adhesive deposits 107 and 109 on each of the outer flaps 106 and 108 aligns with one of the adhesive deposits 103 and 105 on each of the inner flaps 102 and 104. Depending upon the desired strength of the box 100, additional pre-applied adhesive deposits 103, 105, 107 and 109 may be utilized. In addition, the size of each of the pre-applied adhesive deposits 103, 105, 107 and 109 can be enlarged to provide for an increased strength of the box 100. Conversely, where a decreased strength of the box 100 may be desired, the size of the pre-applied adhesive deposits 103, 105, 107 and 109 can be decreased.

Figure 16:
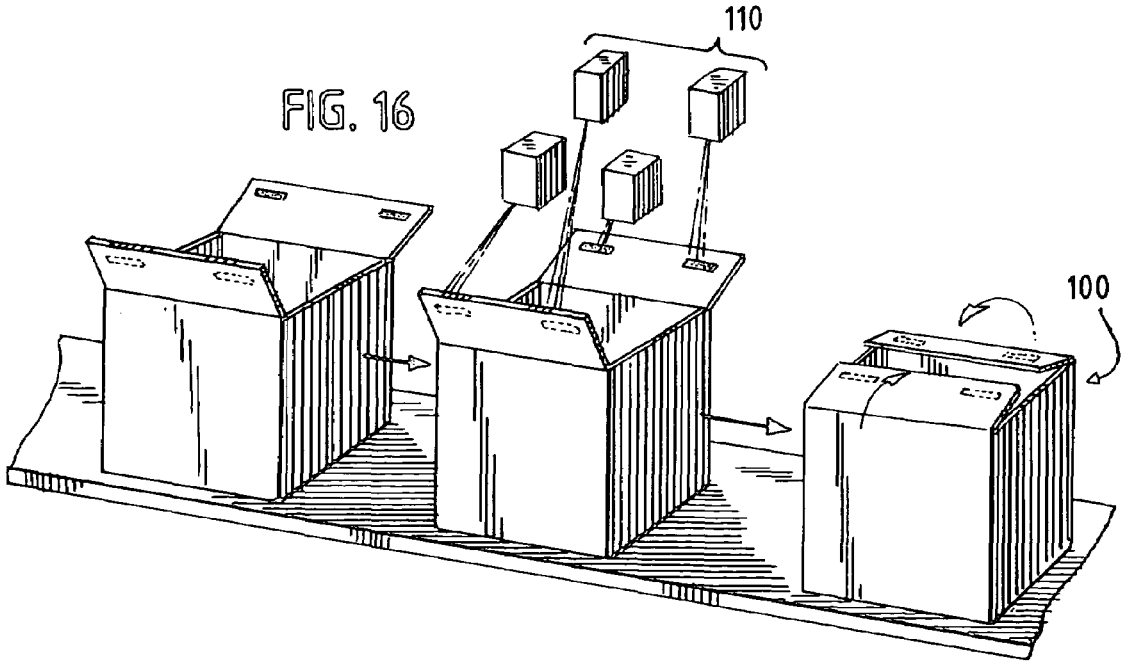
FIGS. 16-18 are diagrammatic illustrations of steps for closing the box of FIG. 15.
Figure 17:
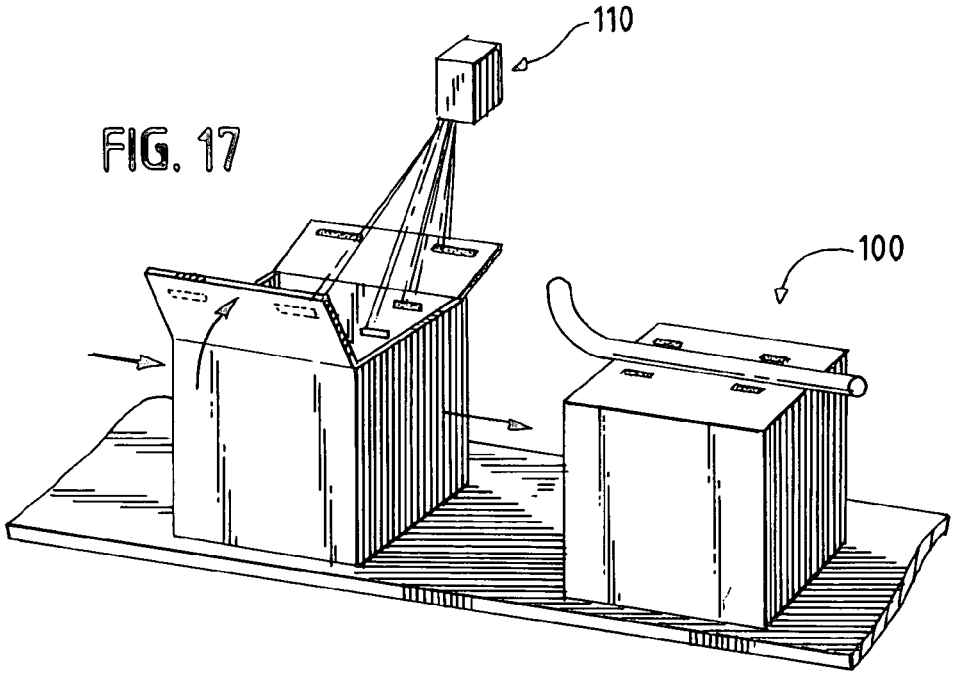
Figure 18:
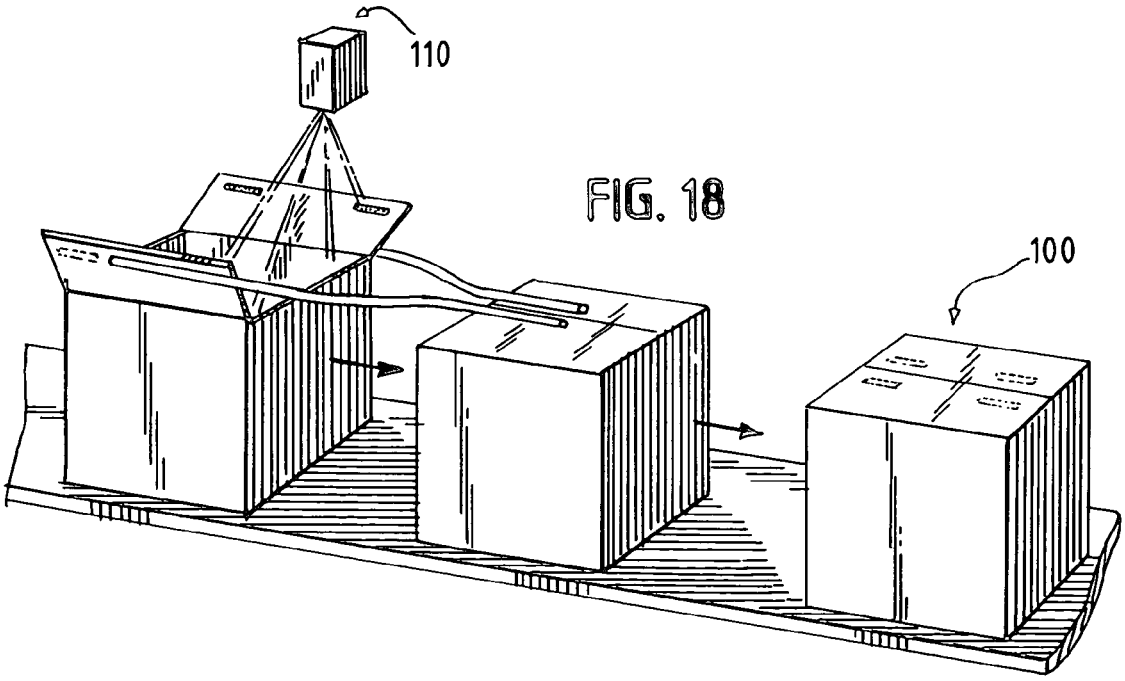
Figure 19:
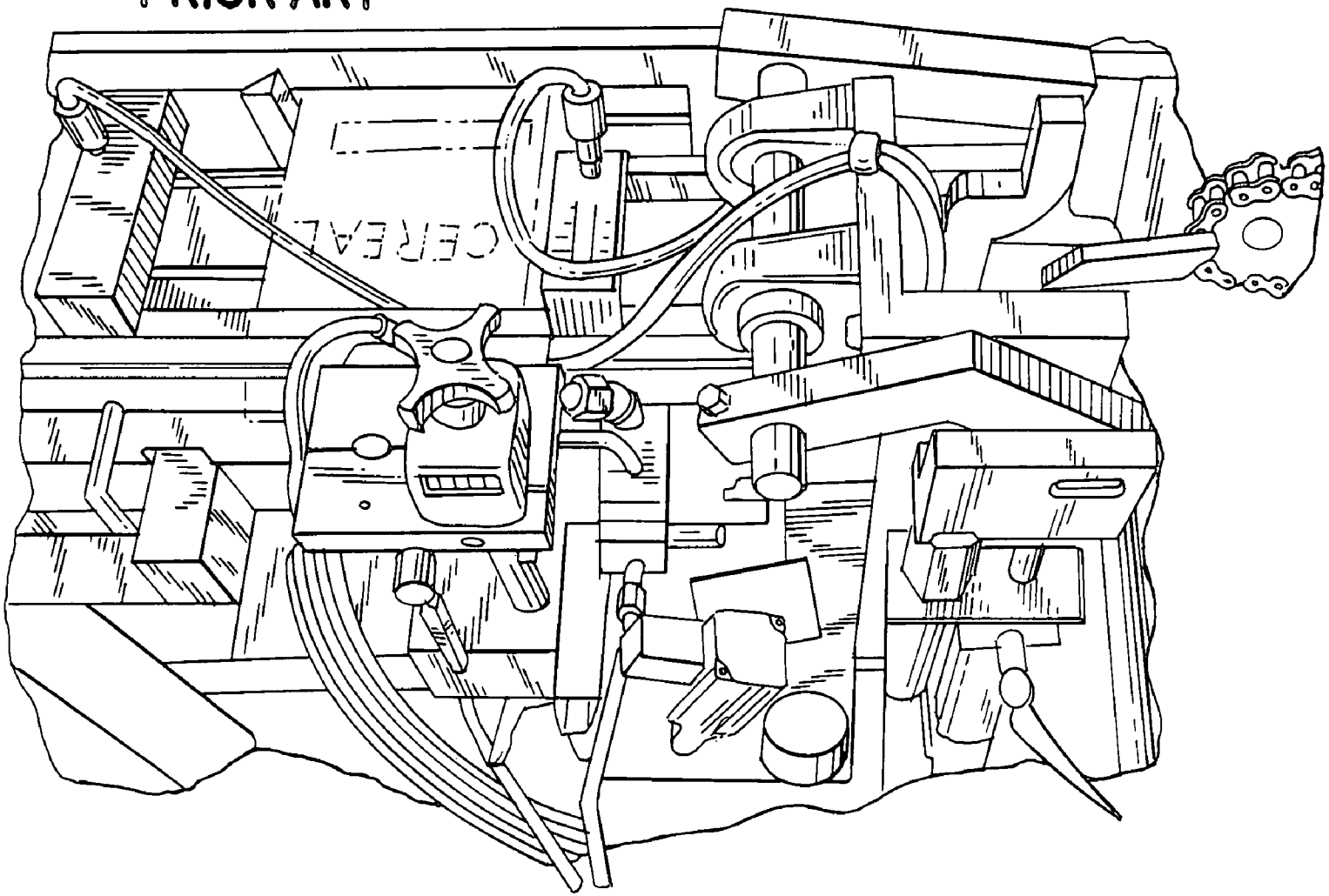
FIG. 19 PRIOR ART
FIG. 19 is a perspective view of a portion of a prior art carton assembling apparatus.

The boxes 100 can be assembled using a variety of different methods, such as those illustrated in FIGS. 16-18. In addition, the boxes 100 can be assembled and/or preformed using the same or similar methods as discussed above with respect to FIG. 4 for other box or carton configurations. For example, the inner flaps 102 and 104 are closed, then the pre-applied adhesive deposits 103, 105, 107 and 109 activated during indexing, and finally the outer flaps 106 and 108 closed and the aligned adhesive deposits 103, 105, 107 and 109 compressed while the box 100 is stationary, as illustrated in FIG. 16. In another variation of assembling the boxes 100, the inner flaps are closed 102 and 104, then the pre-applied adhesive deposits 103, 105, 107 and 109 are activated and the outer flaps 106 and 108 are closed while the box is stationary, then the flaps 102, 104, 106 and 108 are compressed during indexing of the boxes 100, as illustrated in FIG. 17. In yet another variation of assembling the boxes 100, the inner flaps 102 and 104 are closed, then the pre-applied adhesive deposits 103, 105, 107 and 109 are activated while the box 100 is stationary, then the outer flaps 106 and 108 are closed while the box 100 is indexing, then the flaps 102, 104, 106 and 108 are compressed at a stationary location, as illustrated in FIG. 18. The activation of the pre-applied adhesives 103, 105, 107 and 109 in each of these methods may be accomplished using an energy source 110, such as the types discussed hereinabove and illustrated in FIGS. 5-7. Although certain methods of assembling boxes 100 having pre-applied adhesives 103, 105, 107 and 109 are disclosed, other methods of assembling the boxes 100 may also be suitable.

Figure 20:
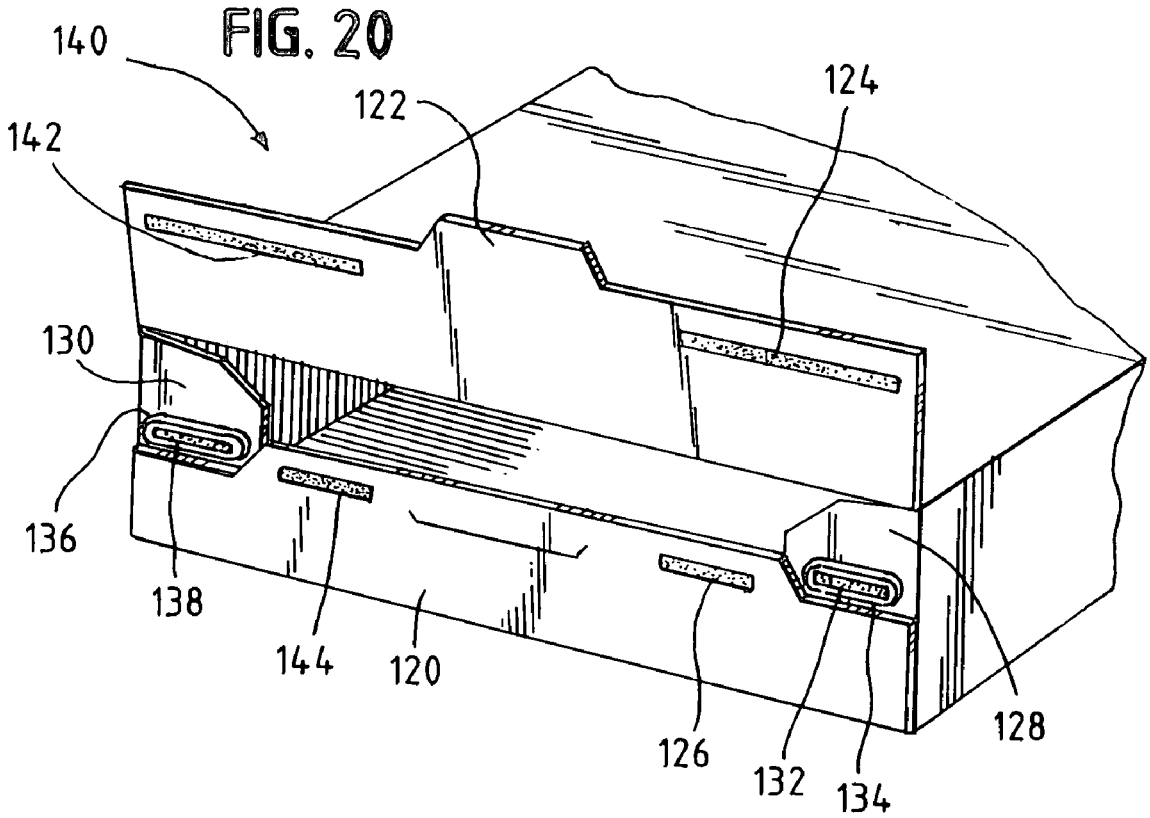
FIG. 20 is a perspective view of a carton in a partially assembled configuration with a second major flap in a raised position and a first major flap in a closed position with adhesive pre-applied to both major flaps and the minor flaps.

Another variation of the carton or boxes having pre-applied adhesive deposits is illustrated in FIG. 20. In the carton 140 of this embodiment, the minor flaps 128 and 130 each have a pre-applied adhesive deposit 134 and 138. In addition, the major flaps 120 and 122 also have pre-applied adhesive deposits 126 and 124. However, the carton 140 is configured such that the adhesive deposits 124 and 142 on the second major flap 122 are elongated, so that when closed one deposit 124 is of such a length so as to align with both adhesive deposit 134 of the minor flap 128 and adhesive deposit 126 of the first major flap 120 and the other deposit 142 is of such a length so as to align with both adhesive deposit 138 of the minor flap 130 and adhesive deposit 144 of the first major flap 120. Optionally, the pre-applied adhesive deposits 134 and 138 of the minor flaps 128 and 130 may be placed upon raised portions 132 and 136 thereof if necessary to accommodate the elevation difference between the minor flaps 128 and 130 and the first major flap 120. The raised portions 132 and 136 may be made by, for example, embossing as an additional step during formation of the carton blank.

As will be appreciated, cartons having pre-applied adhesives and methods for producing and assembling such cartons are disclosed herein. However, the invention is not limited to the preferred embodiments described hereinabove, or to any particular embodiments.

The invention claimed is:

1. A method of assembling a preconfigured carton blank into a carton, the method comprising:

providing the preconfigured carton blank, the preconfigured carton blank having an open end having a first major flap and an opposing second major flap, the first major flap having an activateable adhesive deposit disposed on an outer surface and the second major flap having an activateable adhesive deposit disposed on an inner surface;

activating the adhesive deposits on both the first and second major flaps using an energy source;

moving the first and second major flaps to generally close the open end of the preconfigured carton blank with the second major flap at least partially overlying the first major flap; and at least partially aligning the adhesive deposit on the inner surface of the second major flap with the adhesive deposit on the outer surface of the first major flap to provide an adhesive bond to secure the first and second major flaps relative to each other to generally close the open end of the carton.

2. The method of assembling a preconfigured carton blank into a carton in accordance with claim 1, wherein the step of moving the first and second major flaps occurs prior to the step of activating the adhesive deposits.

3. The method of assembling a preconfigured carton blank into a carton in accordance with claim 1, wherein the step of moving the first and second major flaps occurs after the step of activating the adhesive deposits.

4. The method of assembling a preconfigured carton blank into a carton in accordance with claim 1, wherein the energy source is at least one of a laser, hot air, heat lamp, radio waves and induction heating.

5. The method of assembling a preconfigured carton blank into a carton in accordance with claim 1, wherein the activateable adhesive deposit on the first major flap is different from the activateable adhesive deposit on the second major flap, the activateable adhesive deposits being reactive with each other to provide the adhesive bond.

6. The method of assembling a preconfigured carton blank into a carton in accordance with claim 1, wherein the step of providing the preconfigured carton blank includes the steps of printing graphics on the carton blank and placing the adhesive deposits on the carton blank while the carton blank is in a generally planar configuration.

7. The method of assembling a preconfigured carton blank into a carton in accordance with claim 6, including the steps of providing the preconfigured carton blank with a second open end having a third major flap and an opposing fourth major flap, the third major flap having an activateable adhesive deposit disposed on an outer surface and the fourth major flap having an activateable adhesive deposit disposed on an inner surface;

activating the adhesive deposits on both the third and fourth major flaps proximate the second open end of the carton using an energy source;

moving the third and fourth major flaps to generally close the second open end of the preconfigured carton blank with the fourth major flap at least partially overlying the third major flap; and at least partially aligning the adhesive deposit on the inner surface of the fourth major flap with the adhesive deposit on the outer surface of the third major flap to provide an adhesive bond to secure the third and fourth major flaps relative to each other to generally close the second open end of the carton.

8. The method of assembling a preconfigured carton blank into a carton in accordance with claim 7, wherein the steps of moving the first and second major flaps and the step of moving the third and fourth major flaps occur generally simultaneously and wherein the step of at least partially aligning the adhesive deposit on the inner surface of the second major flap with the adhesive deposit on the outer surface of the first major flap and the step of at least partially aligning the adhesive deposit on the inner surface of the fourth major flap with the adhesive deposit on the outer surface of the third major flap occur generally simultaneously.

9. The method of assembling a preconfigured carton blank in accordance with claim 8, wherein the step of providing the preconfigured carton blank includes the step of providing the preconfigured carton blank in a partially assembled, collapsed state, wherein the carton has front panel and a back panel and a pair of side panels extend between opposing edges of the front and back panel, the first and second major flaps being positioned at edges of the front and back panel other than the edges having the side panels and the third and fourth major flaps being positioned at edges of the front and back panel other than the edges having the side panels and opposite the edges having the first and second major flaps, and in the collapsed stated the front and back panels being generally adjacent each other, the adhesive deposits on the first and second major flaps being unaligned, and the adhesive deposits on the third and fourth major flaps being unaligned.

10. The method of assembling a preconfigured carton blank in accordance with claim 9, wherein the step of providing a carton blank includes the step of removing the preconfigured carton blank from a stack having a plurality of preconfigured carton blanks and the step of shifting the preconfigured carton blank from the collapsed state to an upright state where the sidewalls are approximately perpendicular to the front and back panels.

11. The method of assembling a preconfigured carton blank in accordance with claim 10, including the step of inserting a food product into the preconfigured carton blank through the carton opening prior to the step of moving the first and second flaps to close the carton opening.

12. The method of assembling a preconfigured carton blank in accordance with claim 11, wherein each side panel having a pair of minor flaps positioned on opposing edges thereof adjacent the front and back panels, and including the step of moving the minor flaps to an approximately perpendicular orientation relative to the side panels prior to the step of moving the major panels.

* * * * *